US005596899A

United States Patent [19]

Sendzimir et al.

[11] Patent Number: 5,596,899

[45] Date of Patent: Jan. 28, 1997

[54] MILL HOUSINGS FOR CLUSTER MILLS

[75] Inventors: Michael G. Sendzimir, Woodbury; John W. Turley, Oxford, both of Conn.

[73] Assignee: T. Sendzimir, Inc., Waterbury, Conn.

[21] Appl. No.: 279,048

[22] Filed: Jul. 22, 1994

[51] Int. Cl.[6] ..... B21B 31/24

[52] U.S. Cl. ..... 72/242.4; 72/245; 72/248

[58] Field of Search ..... 72/242.4, 237, 72/238, 248, 241.2, 245

[56] References Cited

U.S. PATENT DOCUMENTS 5,142,896 9/1992 Berger et al. ..... 72/248

FOREIGN PATENT DOCUMENTS 0093505 6/1983 Japan ..... 72/242.4

0023719 2/1993 Japan ..... 72/242.4

*Primary Examiner*—Lowell A. Larson

*Assistant Examiner*—Thomas C. Schoeffler

*Attorney, Agent, or Firm*—Frost & Jacobs

[57] ABSTRACT

A two-part housing assembly for a cluster mill. The housing assembly has substantially the same size, form and structure as a monobloc housing, but is divided along a horizontal plane located at or close to its horizontal center line into upper and lower mill housings each provided with a roll cavity and a roll cluster therein. The gap between the work rolls of the roll clusters is adjusted by symmetrical equal and opposite movement of the upper and lower mill housings achieved by four identical screws, one located in each corner of the mill housing assembly. Each screw has two threaded portions of opposite hand, one threaded portion engaging a threaded nut of opposite hand non-rotatively mounted in a recess in the upper mill housing and the other threaded screw portion engaging a threaded nut of appropriate hand non-rotatively mounted in a recess in the lower mill housing. Each screw supports the upper and lower mill housings. A jack for each screw is provided in the mill base to support and rotate that screw. The upper and lower mill housings are adjustably prestressed together, at a spacing determined by the screws, by a pair of tie rods affixed to the piston of a hydraulic cylinder located at each corner of the mill housing assembly.

15 Claims, 4 Drawing Sheets

MILL HOUSINGS FOR CLUSTER MILLS

TECHNICAL FIELD

This invention relates to a housing for cluster mills used for the cold rolling of metal strip, and more particularly to such a housing having the advantages of a two part structure and the rigidity of a monobloc structure.

BACKGROUND ART

The majority of cluster mills for cold rolling metal strip have been provided with monobloc housings of the type shown in U.S. Pat. Nos. 2,169,711; 2,187,250; and 2,776,586, or of the improved type taught in U.S. Pat. No. 3,815,401, and also illustrated in FIGS. 1*a* and 1*b* herein.

The advantage of the monobloc housing over any other housing type is great rigidity which is required in order to roll strip having the greatest uniformity in thickness. It will be noted by one skilled in the art that, as time progresses, requirements for gauge accuracy (i.e. thickness uniformity) are becoming increasingly stringent.

However, there are some disadvantages with respect to the monobloc housing, which, for some applications, can cause serious difficulties. These disadvantages can be summarized as follows:

Firstly, if a mill wreck occurs, i.e. the strip breaks and then accumulates in a tangled mass of scrap inside the housing, it sometimes takes several hours to remove the tangled strip, to enable rolling to recommence, and so significant lost production occurs. It would be advantageous in such cases to be able to separate upper and lower halves of the housing to provide more room for removal of scrap strip. This is particularly important for high speed mills.

Secondly, for some applications, it would be advantageous to be able to roll with a larger range of work roll diameters than can be achieved with a monobloc housing.

Thirdly, the ability to separate upper and lower halves of the housing would facilitate threading of the strip.

Fourthly, the ability to mount force measuring devices between upper and lower halves of the housing would enable more accurate measurement of roll separating force, which could be useful for purposes of data logging and improving accuracy of automatic gauge control systems.

Prior art alternative housing designs have overcome some of these difficulties in some cases and, in other cases, have overcome all of the difficulties, but paid the penalty of a great reduction in mill rigidity. Some examples of such prior art are shown in FIGS. 2, 3*a* and 3*b*.

In FIG. 2, the housing is made in two halves, an upper half 112 and a lower half 113 which are clamped together using four hydraulic cylinders 115 (one at each corner) and fixed spacers 116 to separate upper and lower halves at a predetermined spacing. This design gives a rigidity close to that of the monobloc housing, but permits the upper and lower housing halves to be separated by operating the hydraulic cylinders in the appropriate direction. With this design, all four difficulties can be overcome, but two disadvantages remain. One is that it is necessary to change spacers 116 to permit a substantial change in work roll diameter. This is an inconvenience in applications where such diameter changes are frequent. Secondly, if there is a substantial change in work roll diameter, and spacers 116 are changed to suit, then the pass line height changes, because the lower housing is fixed. This can cause difficulties because other devices such as work roll thrust bearings, strip wipers, thickness gauges, mill drive spindles all operate best at a fixed pass line level.

In FIGS. 3*a* and 3*b* the mill housing is split into two halves and reduced in width so that the two halves can fit in the windows of two four-high type mill housings, utilizing the standard screwdown and pass line height adjusting mechanisms built-in to the four-high housings. FIGS. 3*a* and 3*b* show a hydraulic screwdown cylinder 109 at the bottom of each housing window and a screw 108 and nut for pass line height adjustment at the top of each housing window. This design overcomes all four of the above difficulties, but gives a much less rigid (and much more expensive) structure than the monobloc housing.

The present invention is based upon the discovery that a mill housing assembly for a cluster mill can be provided having substantially the same size, form and structure as a conventional monobloc mill housing. The mill housing assembly of the present invention is divided along a horizontal plane close to or at its horizontal center line into an upper mill housing and a lower mill housing. By provision of jack and screw assemblies at the four corners of the mill housing assembly, and by provision of adjustable tie rod means at the four corners of the mill housing assembly, a structure can be provided which compares favorably with a monobloc mill housing from the standpoint of rigidity, while possessing all of the advantages of a two-piece mill housing including the ability to separate the upper and lower mill housings to clear wrecks, a wide range of roll gap settings, and the operation of a fixed pass line level.

DISCLOSURE OF THE INVENTION

According to the invention there is provided a two-part housing assembly for a cluster mill. The housing assembly has substantially the same size, form and structure as a monobloc housing. The housing assembly is divided along a horizontal plane close to or at its horizontal center line into an upper mill housing and a lower mill housing. Each mill housing is provided with a roll cavity and a roll cluster in the roll cavity. Each roll cluster comprises a work roll, intermediate rolls and backing assemblies.

The gap between the work rolls of the roll clusters is adjusted by symmetrical equal and opposite movement of the upper and lower mill housings. To accomplish this, four identical screws are provided, one located in each corner of the mill housing assembly. Each screw has two threaded portions of opposite hand. One threaded portion of each screw engages an appropriately threaded nut non-rotatively mounted in a corner recess of the upper mill housing. Similarly, the other threaded portion of each screw engages an appropriately threaded nut non-rotatively mounted in a corner recess in the lower mill housing. As a consequence, rotation of all of the screws in one direction will cause the upper and lower mill housings to separate vertically. Similarly, rotation of all of the screws in the opposite direction will cause the upper and lower mill housings to shift vertically toward each other. Since both mill housings move equally in opposite directions, the pass line is fixed.

Both the upper mill housing and the lower mill housing are supported by the four screws. The four screws, in turn, are supported by and rotated by four jacks mounted in the mill base. Each of the jacks has an input shaft connected to a motor. The input shafts of the jacks located at the forward corners of the mill housing assembly are connected together. Similarly, the input shafts of the jacks located at the rearward corners of the mill housing are also connected together.

At each comer of the mill housing assembly, a hydraulic cylinder is mounted at the top of the upper mill housing. Each cylinder has a piston. Each piston is connected to a pair of tie rods which pass with clearance through bores in the upper mill housing and are threadedly engaged in bores in the lower mill housing. The four hydraulic cylinder/tie rod assemblies adjustably prestress the upper and lower mill housings together, at a spacing determined by the screws.

DETAILED DESCRIPTION OF THE INVENTION

Figure 1B:
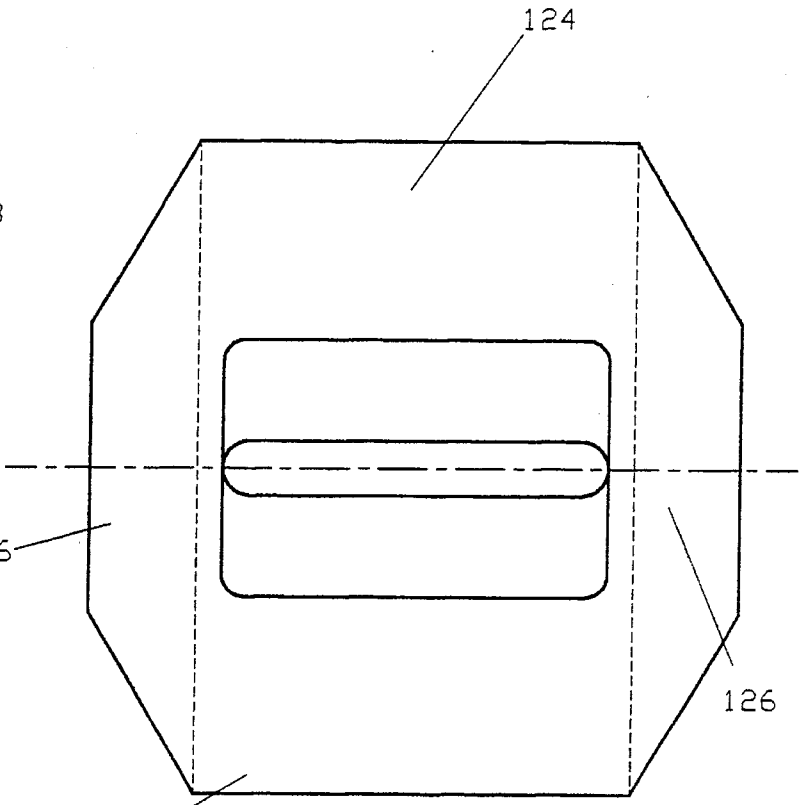
FIG.1b PRIOR ART
FIGS. 1*a* and 1*b* are, respectively, front and side elevational view of a prior art monobloc housing for a cluster mill.

For all of the cluster mill housing types shown in the drawings, the housings or housing elements are provided with four upper partial bores 110 and four lower partial bores 111. These upper and lower partial bores define the periphery of the upper and lower portions of the roll cavity of the housing. In a monobloc housing such as that of FIG. 1, the roll cavity constitutes a single cavity. In a two part mill housing, the upper portion of the roll cavity is formed in the upper housing part and the lower portion of the roll cavity is formed in the lower housing part, as shown in FIGS. 2, 3*a*, 3*b*, 4 and 5. As is best shown in FIG. 1*a*, work rolls 104, between which the roll gap is formed and between which the strip 105 passes and is rolled, are each supported by two first intermediate rolls 103. The two first intermediate rolls 103 are supported by three second intermediate rolls 102 which, in turn, are supported by four sets of caster bearings 101. As is well known in the art, each set of caster bearings is mounted on a common shaft 106, and this shaft is supported against the adjacent one of the mill housing partial bores 110 or 111 by a set of saddles 1.07, such saddles being located at each end of the shaft, and between each caster bearing and its neighbor on the shaft. Each assembly of caster bearings, shaft and saddles is known as a backing assembly, there being 8 backing assemblies in all. Conventionally, the 8 backing assemblies are designated A through H as shown in FIG. 1. Each set of one work roll, two first intermediate rolls, three second intermediate rolls and four backing assemblies is known as a roll cluster. There are two roll clusters, an upper one and a lower one. Such clusters are known in the art as 1–2–3–4 or 20-high clusters. This invention applies to mills having this cluster type and also to mills having the cluster type known in the art as 1–2–3 or 12-high clusters.

Figure 1A:
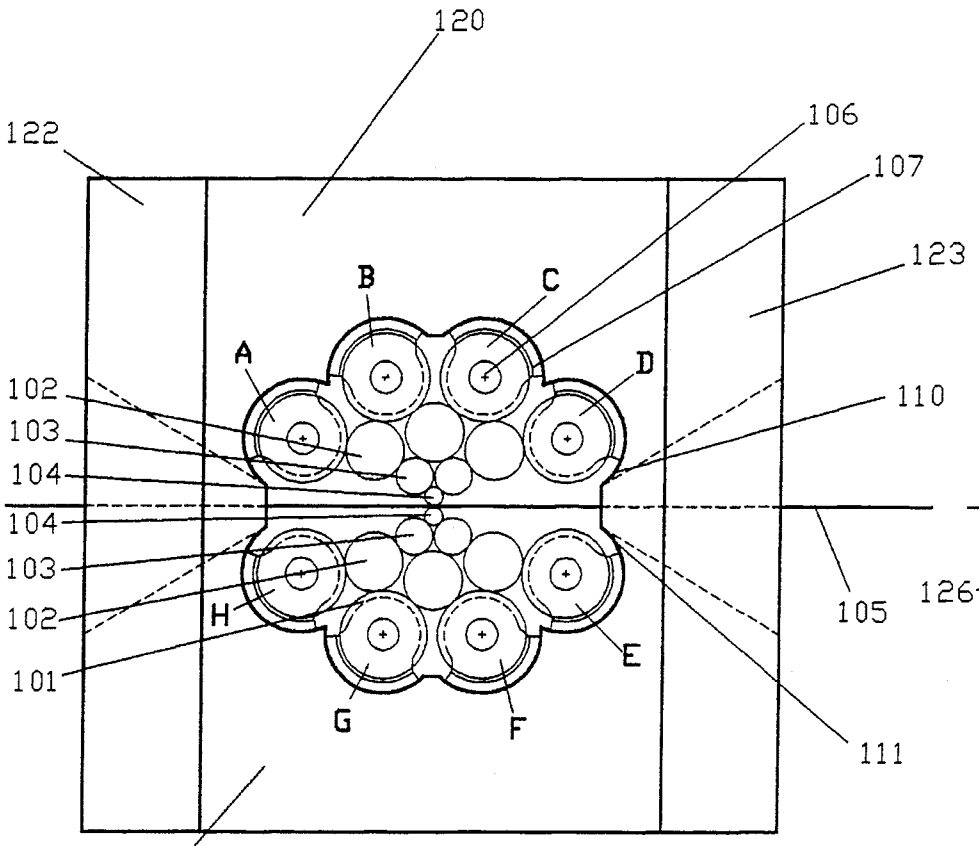
FIG.1a PRIOR ART

The monobloc housing of FIGS. 1*a* and 1*b* can be described as consisting of a roof portion 120, in which partial bores 110 are formed, a floor portion 121 in which partial bores 111 are formed, and two side frame portions 122 (left side) and 123 (right side) which connect the roof and floor portions. Each side frame portion consists of an upper beam portion 124 and a lower beam portion 125, these beam portions being connected together at their ends by the column portions 126. During rolling, the action of the roll separating force tends to force the roof portion 120 up and the floor portion 121 down. This force is transmitted by shear through roof and floor portions to beam portions 124 and 125 respectively of the side frame portions 122 and 123, and the separating force is reacted by tension in column portions 126.

Figure 2:
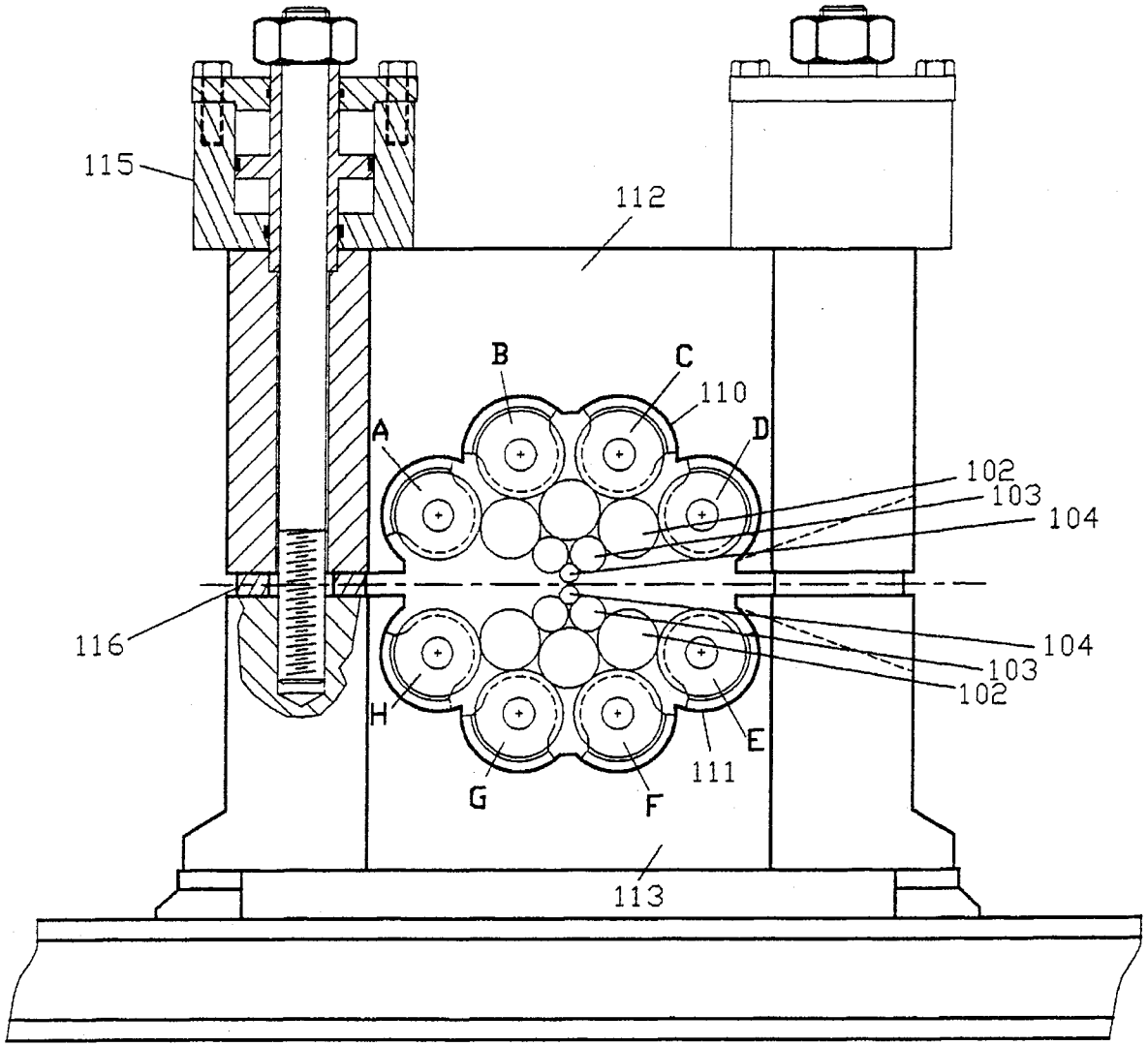
FIG.2 PRIOR ART
FIG. 2 is a front elevational view, partly in cross section, of a prior art split housing for a cluster mill.

In the case of the monobloc housing of FIGS. 1*a* and 1*b* and the prestressed housing of FIG. 2, an eccentric is mounted between each saddle and its shaft on at least some of the backing assemblies. The eccentrics are keyed to their respective shaft, such that rotation of the shaft causes movement of shaft axis (and hence of caster bearings mounted on that shaft). Backing assemblies B and C, which are so equipped, are used as screwdown means to directly adjust roll gap. Similarly equipped backing assemblies F and G are used for pass line adjustment and thus affect roll gap. Similarly equipped backing assemblies A, H, D and E make adjustment for roll wear and have some affect on roll gap. Of course, the range of adjustment of roll gap achieved by the use of eccentrics on the backing assemblies is limited, even if eccentrics are provided on all eight backing assemblies A–H. Typically, for a 50 inch wide mill, screwdown and pass line adjustment are limited to about ⅜ inch each, and adjustment for roll wear is limited to about ½ inch.

Figure 3B:
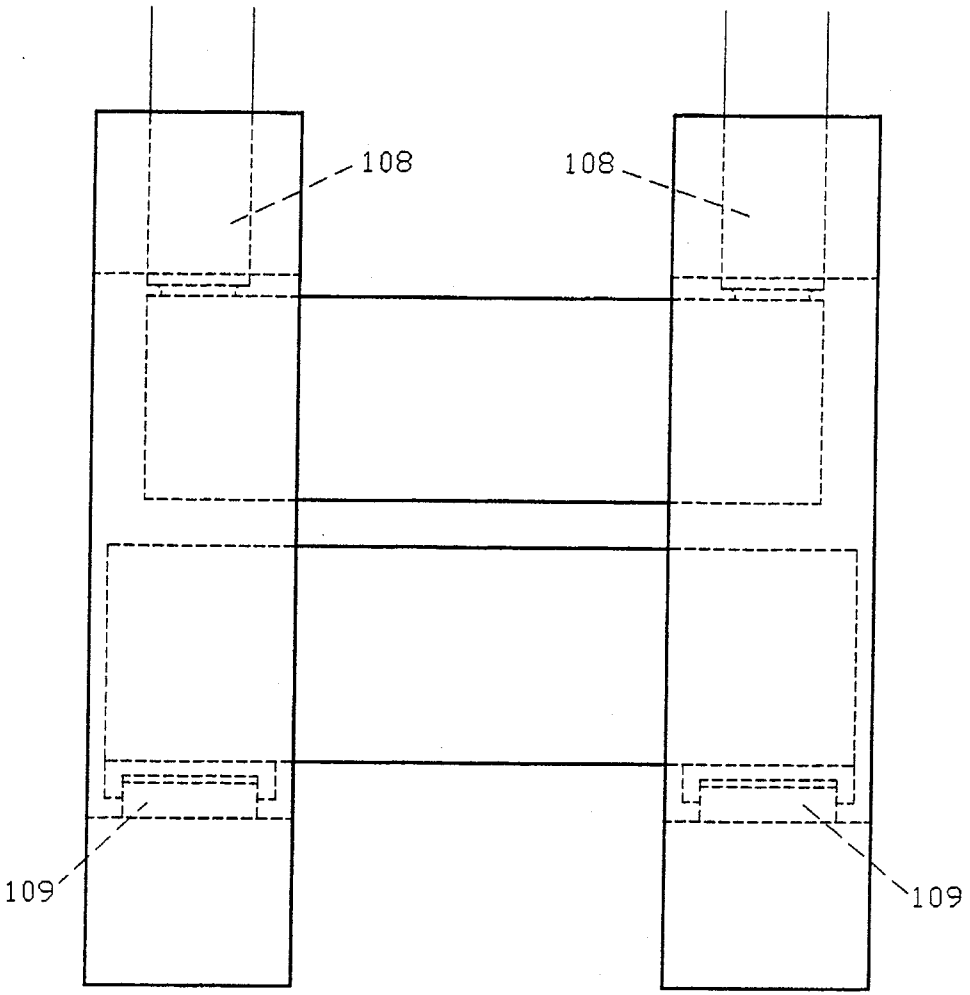
FIG. 3b PRIOR ART
FIGS. 3*a* and 3*b* illustrate, respectively, front and side elevational views of a prior art cluster mill housing structure, comprising cluster mill housing structural elements mounted within four high type mill housings.
Figure 3A:
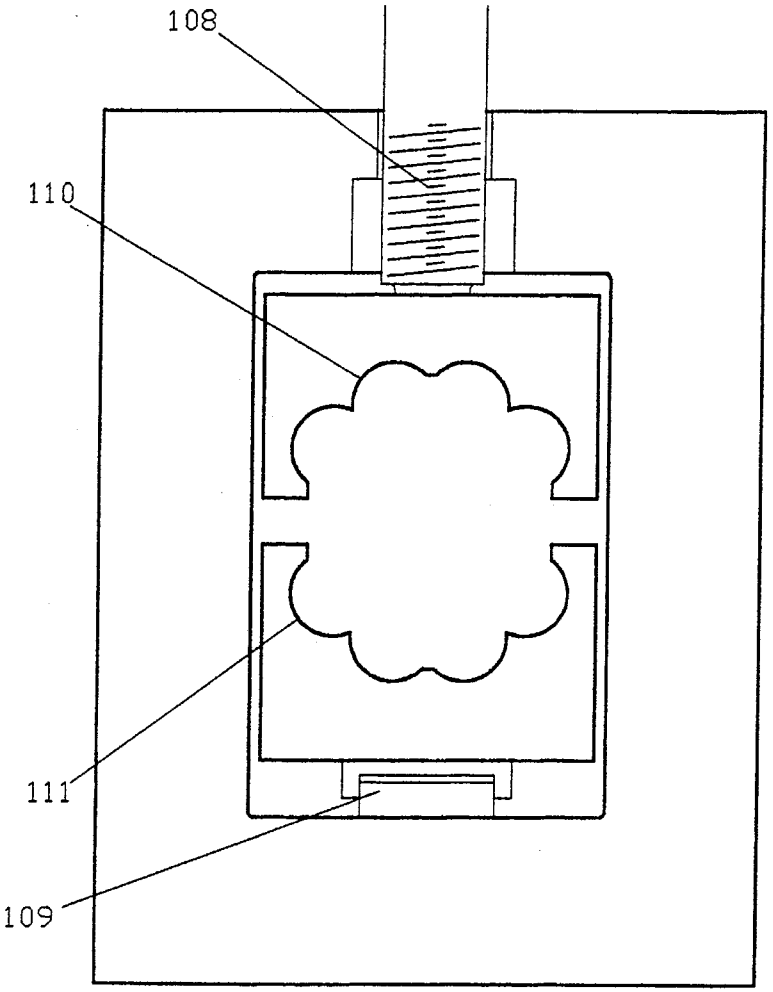
FIG. 3a PRIOR ART

In the case of the housing design of FIGS. 3*a* and 3*b*, the roll gap is adjusted by means of hydraulic screwdown cylinders 109 and/or rotation of pass line height adjustment screws 108 so it is not necessary to provide eccentrics on the backing assemblies. In this case total adjustment of roll gap of 5 or 6 inches, or even more, is easily obtainable.

Figure 5:
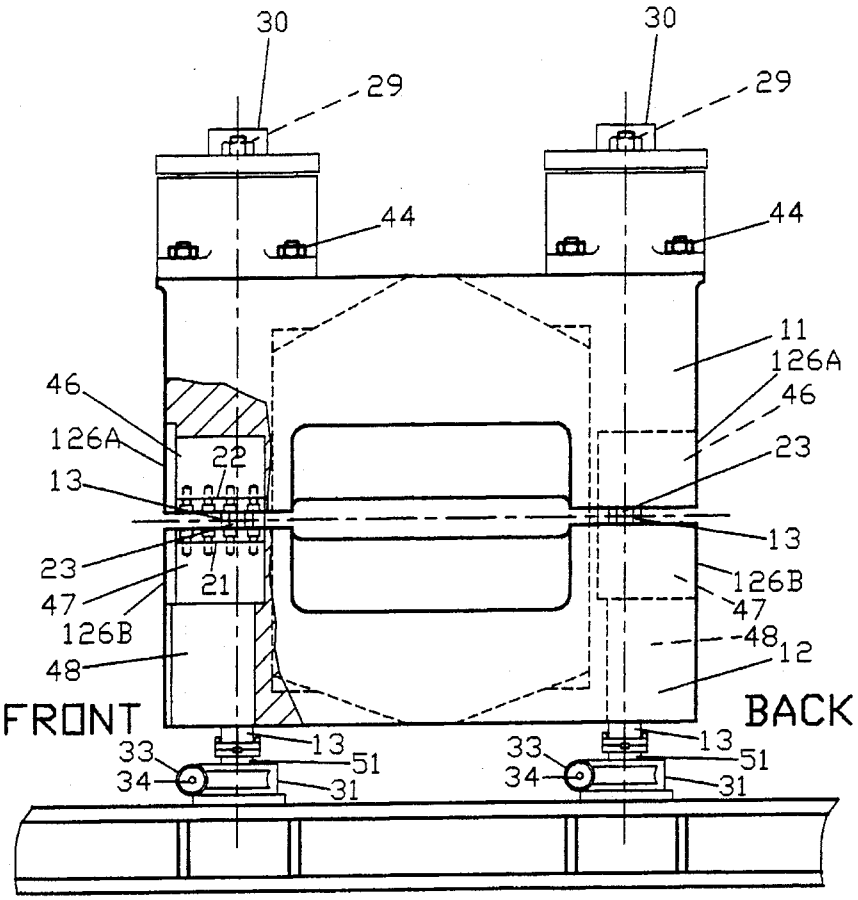
FIG. 5 is a side elevational view, partly in cross section, of the cluster mill housing of FIG. 4.
Figure 4:
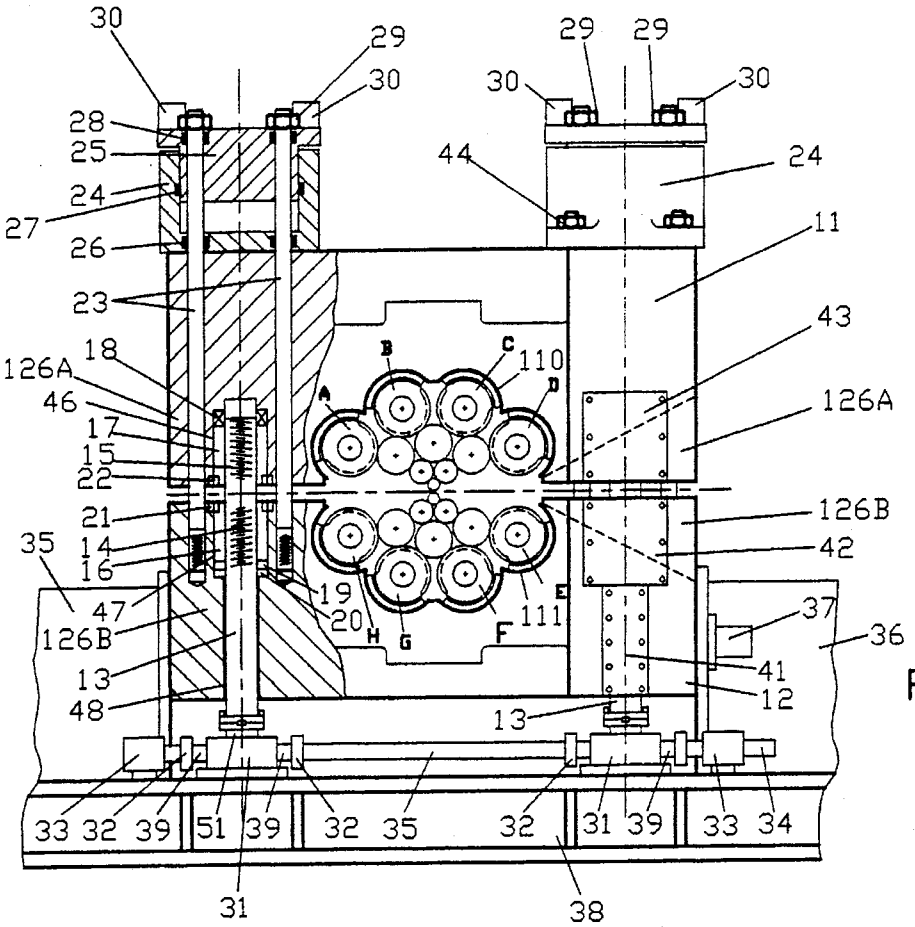
FIG. 4 is a front elevational view, partly in cross section, of a cluster mill housing according to the present invention.

A preferred embodiment of the present invention is shown in FIGS. 4 and 5. The objective of this invention is to combine the rigidity of the prior art monobloc housing of FIG. 1 with the adjustability and wide range of roll gap setting of the prior art arrangement of FIG. 3.

The mill housing, which is similar in form, structure, and size to that of FIG. 1, is split along a horizontal plane close to or at its horizontal center line into an upper housing 11 and a lower housing 12, columns 126 each being split into an upper portion 126A (part of the upper housing) and a lower portion 126B, (part of the lower housing). The upper and lower housings are mounted on, and spaced apart by four screws 13, one at each corner, located substantially at the centers of the column portions 126A and 126B. Each screw 13 is provided with a right hand thread 15, engaging an upper nut 17, and a left hand thread 14, engaging a lower nut 16 (See FIG. 4). Each upper nut 17 is located in a recess 46 in its respective housing corner, and is provided with a commercially available ring-shaped load cell 18 (such as the "Pressductor"® type manufactured by ABB Inc. of Milwaukee, Wis.) mounted concentrically on its upper surface. Top housing 11 rests upon the four load cells 18, and its weight is transmitted through these load cells, and through nuts 17 to screws 13.

Each lower nut 16 is located in a recess 47 in its respective housing corner and rests upon spherical thrust washer pair 19/20 which, in turn, rests in the bottom of its recess 47.

Each lower nut 16 is keyed to lower housing 12 by keys 21, which are bolted to the housing. When the mill is not loaded, lower housing 12 hangs on the four nuts 16 by means of keys 21, and its weight is thereby transferred to, and is supported by the four screws 13. Keys 21 also prevent rotation of nuts 16.

Each upper nut 17 is keyed to upper housing 11 by keys 22. These keys prevent rotation of nuts 17, but do not support any load.

Each screw 13 is supported by a jack 31. Jack 31 is a commercial unit having an output shaft 51 which rotates but does not move axially (such as rotating screw type jacks made by Duff-Norton Co. of Charlotte, N.C.). Such jacks incorporate a heavy thrust bearing to support high axial loads on their output shaft 51. The output shaft 51 of each jack 31 is bolted and keyed to its respective screw 13.

Thus, them are four jacks 31, one at each corner of lower housing 12, two being at the front, as shown in FIG. 4, and appearing to the left in FIG. 5, and two being at the back, as shown to the right in FIG. 5.

As is best illustrated in FIG. 4, the input shaft 39 of each front jack 31, is double ended and is coupled to the input shaft of the other front jack 31 via couplings 32 and cross shaft 35. The other end of each input shaft 39 is driven by a hydraulic or electric motor 33 via a coupling 32. Encoder 34 is connected to one of the motors 33, and is used to sense angular position of input shafts 39. An identical arrangement is used for the two back jacks.

By operating both pairs of motors (front pair and back pair) together, the four screws 13 rotate, and raise top housing 11 and lower bottom housing 12, or raise bottom housing 12 and lower top housing 11, according to the direction of rotation of the motors 33.

Since the pitches of the left and right hand threads 14 and 15 in screws 13 are equal, the movements of top housing 11 and bottom housing 12 are always equal and opposite i.e. the plane of symmetry of the two housings always remains fixed. The plane of symmetry of the pinion stand (not shown) is made the same as that of the housings, the level of this plane being known as the pass line level. This feature is of great value in ensuring that the misalignment angles of upper and lower pairs of drive spindles (not shown) will always be substantially equal. As a consequence, the drive spindle strength is not compromised.

By operating the front pair of motors 33 alone, or the back pair of motors 33 alone, or driving front and back pairs in opposite directions, it is possible to tilt the upper housing 11 and lower housing 12 in opposite directions, thus forming a tapered form of roll gap, (where the roll gap is different at front and back of the mill) or, in the case of an initially tapered roll gap, correcting the roll gap to a parallel form in order to "level" the mill, as is known in the art. Such adjustments can be useful when rolling strip of non-uniform thickness, such as "wedge shaped" strip. Spherical washers 19 and 20 permit this tilt to take place without bending screws 13.

During the rolling process, which reduces the thickness of the strip being rolled, a roll separating force (RSF) is developed, which acts, substantially vertically upwards on the upper roll cluster, and reacts substantially vertically downwards on the lower roll cluster.

Since the magnitude of this force will usually be considerably higher than the weight of the upper roll cluster and upper housing 11, it is necessary to apply a prestressing force which preloads upper and lower housings 11 and 12 together, this force being greater than the maximum RSF developed during rolling.

The force is applied by four hydraulic cylinders acting through tie rods 23, which clamp the upper and lower housings 11 and 12 together against the spacing structure formed by load cells 18, nuts 17, threaded portions 15 and 14 of screws 13, nuts 16 and spherical washers 19 and 20.

Because nuts 17 are each mounted at the inner faces of upper and lower housings, i.e. the faces which are closest to the pass line the portion of each screw 13 which is under load, i.e. that portion between threaded portions 14 and 15, is as short and therefore as rigid as it could possibly be. Thus, the rigidity of the spacing structure is extremely high and the rigidity of the total structure consisting of upper and lower housings, and the spacing structure is only slightly less than that of a monobloc housing.

It should be understood that this rigidity is only maintained under the condition that the loaded portions of screws 13 are under compression. Thus, the prestressing force must be higher than the maximum roll separating force developed during rolling, to achieve this high rigidity.

The design principle used here is known as the "short stress path" principle. Thus, the item which is subjected to the highest stress (the portion of screws 13 between threaded portions 14 and 15) is kept as short as possible in order to achieve maximum rigidity.

Each hydraulic cylinder comprises a cylinder body 24, attached to upper mill housing 11 by bolts 44, a piston 25 which slides within the cylinder body 24, piston rods 23, which also fulfill the function of tie rods, and nuts 29 which secure piston 25 on the piston rods 23. Seals 26, 27 and 28 are provided to prevent leakage of hydraulic fluid from the cylinder 24. Keys 30, bolted to piston 25, are used to lock nuts 29 against rotation and also to secure nuts 29 to piston 25, so that the weight of the piston is supported by rods 23. Piston 25 is connected to lower housing 12 by the two piston rods (tie rods) 23 which are screwed into threaded bores in the lower housing 12.

This design of the hydraulic cylinder 24 is unique in that each cylinder 24 has two parallel non co-axial piston rods 23 rather than the usual one. The purpose of this is to enable each cylinder 24 to be mounted co-axially with its respective screw 13, giving uniform stress in its respective screw 13 when the prestressing force is applied by supplying pressurized hydraulic fluid to the cylinder 24. To achieve this, the two tie rods 23 straddle their respective screwdown nuts 16 and 17, and the axes of the two rods 23 and their respective nuts 16 and 17 all lie in one vertical plane.

Although it is envisaged that this construction will provide many years of service with no maintenance other than lubrication, the invention provides for easy replacement of all parts. Each hydraulic cylinder 24 can be removed by removing its four bolts 44, one hydraulic hose (not shown), its two keys 30 and two nuts 29, and lifting the cylinder away. The rods 23 can then be unscrewed and lifted out.

Load cells 18 can be removed by operating motors 33 to separate upper and lower housings as far as possible. Thereafter a hydraulic jack can be placed between upper and lower housings 11 and 12 adjacent to the load cell 18 in question to take the weight of the upper housing 11 off the load cell 18. Then the load cell can be slid out horizontally to the front (front load cells) or to the back (back load cells) through the slot or recess 46 provided for the purpose in the upper housing, after first removing cover/retainer 43 (see FIG. 4) which serves to cover and retain load cell 18 and upper nut 17. This is accomplished by removing the screws which attach cover/retainer 43 to the upper housing.

A similar cover 42 is provided in lower housing 12 for recess 47, and a long narrow cover 41 is provided for recess 48 (see FIG. 4). If these covers are removed, as well as cover 43, it is possible to slide out the entire assembly of screw 13, nuts 16 and 17, load cell 18 and washers 19 and 20, from recesses 46, 47 and 48 for examination, replacement or repair. In such a case, the corner of lower housing 12 in question would be blocked, and the bolts and keys attaching screw 13 to output shaft 51 of that jack 31 supporting the screw 13 in question would be removed, before the assembly could be slid out. It will be understood that a set of covers 41, 42 and 43 will be provided for the recesses 46, 47 and 47 for each screw assembly (13, 16, 17, 18, 19 and 20).

It is envisaged that, with a mill according to this invention, the standard screwdown system operating via eccentrics on B and C backing assemblies would be retained. Furthermore, the pass line height adjusting system operating via eccentrics on F and G backing assemblies would be retained to provide for differences in roll sizes between upper and lower clusters. However, it would not be necessary to provide eccentrics on A, D, E and H backing assemblies, since the symmetrical housing separation adjustment achieved by rotation of screws 13 would provide for roll wear.

Modifications may be made in the invention without departing from the spirit of it.

What is claimed:

1. A cluster mill housing assembly having substantially the same size, form and structure as a monobloc mill housing, said cluster mill housing assembly having a horizontal center line and being divided along a horizontal plane located at or close to said horizontal center line of said housing assembly into upper and lower mill housings, said mill housing assembly having two forward and two rearward corners, each of said mill housings having a roll cavity and a roll cluster in said cavity, each roll cluster comprises a work roll, intermediate rolls and backing assemblies, a gap defined between said work rolls, screw and nut assembly means mounted at each of said four mill housing assembly corners for adjusting said work roll gap by shifting said upper and lower mill housings toward and, simultaneous and symmetrically about a fixed plane coincident with said horizontal center line, away from each other depending upon the direction of rotation of said screws of said screw and nut assembly means, means for supporting said screw means and for rotating said screw means, said screw means supporting the weight of said upper and lower mill housings, and means for prestressing said upper and lower mill housings together at a spacing therebetween determined by said screw means.

2. The cluster mill housing assembly claimed in claim 1 wherein said roll clusters are 12-high clusters.

3. The cluster mill housing assembly claimed in claim 1 wherein said roll clusters are 20-high clusters.

4. The cluster mill housing assembly claimed in claim 1 including a fixed pass line level.

5. The cluster mill housing assembly claimed in claim 1 wherein each of said four screw and nut assemblies comprises a screw having first and second threaded portions of opposite hand and equal pitch, an upper nut non-rotatively mounted in one of four blind recesses each having a closed upper end and each being located in a corner of said upper mill housing, and a lower nut non-rotatively mounted in one of four blind recesses each having a closed bottom end and each being located in a corner of said lower mill housing, said upper nuts and said lower nuts having threads of opposite hand, each screw having its first threaded portion threadedly engaged in its respective upper nut and its second threaded portion threadedly engaged in its respective lower nut, whereby rotation of all screws by said screw rotating means in a first direction will cause said upper and lower mill housings to separate vertically and rotation of all screws by said screw rotating means in a second direction will cause said upper and lower mill housings to shift vertically toward each other, equal rotation of all screws will cause said upper and lower mill housings to shift equal distances vertically and oppositely.

6. The cluster mill housing assembly claimed in claim 5 wherein said prestressing means comprises a hydraulic cylinder mounted at each corner of said mill housing assembly at the top of said upper mill housing, each of said cylinders having a piston therein, a pair of tie rods connected to each piston, each pair of tie rods passing with clearance through bores in the upper mill housing and being threadedly engaged in threaded bores in said lower mill housing, said tie rods of each cylinder being located to either side of its respective one of said screw and nut assembly means with the axes of each of said pairs of tie rods, and its respective upper and lower nuts and screw lying in substantially the same vertical plane.

7. The cluster mill housing assembly claimed in claim 5 including a jack for each of said screws, each jack supporting its respective one of said screws, each of said jacks having a rotatable output shaft which is fixed with respect to movement in an axial direction and which is affixed to its respective one of said screws, an input shaft for each of said jacks, each input shaft having first and second ends, a prime mover for each jack, each of said prime movers being drivingly attached to said first end of said input shaft of its respective jack.

8. The cluster mill housing assembly claimed in claim 7 including a cross shaft coupling together said second ends of said jack input shafts of said jacks at said forward corners, a cross shaft coupling together said second ends of said jack input shafts of said jacks at said rearward corners, whereby all four screws can be operated simultaneously to shift said upper and lower housings vertically toward and away from each other and whereby said screws at said forward corners and said screws at said rearward corners can be rotated independently to tilt said upper and lower housings to create a tapered roll gap or to level said cluster mill.

9. The cluster mill housing assembly claimed in claim 5 wherein each upper nut is located in its recess in its respective upper housing corner, a ring-shaped load cell mounted concentrically on top of each of said upper nuts, said upper mill housing resting upon said load cells with the weight of said upper housing being transmitted through said load cells and said upper nuts to said screws, each of said lower nuts being located in its recess in its respective lower housing corner, a spherical thrust washer pair beneath each lower nut within its respective recess and resting on said bottom end of said recess, keys keying said lower nuts to said lower housing, when said cluster mill is not loaded, said lower housing hangs upon said four lower nuts by said keys with the weight of said lower housing being transferred to and supported by said four screws.

10. The cluster mill housing assembly claimed in claim 6 including a jack for reach of said screws, each jack supporting its respective one of said screws, each of said jacks having a rotatable output shaft which is fixed with respect to movement in an axial direction and which is affixed to its respective one of said screws, an input shaft for each of said jacks, each input shaft having first and second ends, a prime mover for each jack, each of said prime movers being drivingly attached to said first end of said input shaft of its respective jack.

11. The cluster mill housing assembly claimed in claim 10 including a cross shaft coupling together said second ends of said jack input shafts of said jacks at said forward corners, a cross shaft coupling together said second ends of said jack input shafts of said jacks at said rearward corners, whereby all four screws can be operated simultaneously to shift said upper and lower housings vertically toward and away from each other and whereby said screws at said forward corners and said screws at said rearward corners can be rotated independently to tilt said upper and lower housings to create a tapered roll gap or to level said cluster mill.

12. The cluster mill housing assembly claimed in claim 11 wherein said prestressing means comprises a hydraulic cylinder mounted at each corner of said mill housing assembly at the top of said upper mill housing, each of said cylinders having a piston therein, a pair of tie rods connected to each piston, each pair of tie rods passing with clearance through bores in the upper mill housing and being threadedly engaged in threaded bores in said lower mill housing, said tie rods of each cylinder being located to either side of its respective one of said screw and nut assembly means with the axes of each of said pairs of tie rods, and its respective upper and lower nuts and screw lying in substantially the same vertical plane.

13. The cluster mill housing assembly claimed in claim 12 including a fixed pass line level.

14. The cluster mill housing assembly claimed in claim 13 wherein said roll clusters are 12-high clusters.

15. The cluster mill housing assembly claimed in claim 13 wherein said roll clusters are 20-high clusters.

* * * * *

UNITED STATES PATENT AND TRADEMARK OFFICE

CERTIFICATE OF CORRECTION

PATENT NO. : 5,596,899

DATED : January 28, 1997

INVENTOR(S) : Michael G. Sendzimir & John W. Turley

It is certified that error appears in the above-indentified patent and that said Letters Patent is hereby corrected as shown below:

Column 8, line 50 (claim 10), "claim 6" should read as --claim 9--.

Column 8, line 51 (claim 10), the word "reach" should read as --each--.

Signed and Sealed this

Eighth Day of July, 1997

Bruce Lehman

*Attest:*

BRUCE LEHMAN

*Attesting Officer*

*Commissioner of Patents and Trademarks*